United States Patent [19]

Fowler

[11] Patent Number: 4,934,076

[45] Date of Patent: Jun. 19, 1990

[54] PERPETUAL CALENDAR

[76] Inventor: Eugene C. Fowler, 5611 S. Honey Creek Dr., Milwaukee, Wis. 53211

[21] Appl. No.: 331,516

[22] Filed: Mar. 31, 1989

[51] Int. Cl.[5] ..... G09F 3/00

[52] U.S. Cl. ..... 40/107; 40/124

[58] Field of Search ..... 40/107, 642, 124

[56] References Cited

U.S. PATENT DOCUMENTS

| | | | |
|---|---|---|---|
| 166,796 | 8/1875 | Miller | 40/107 |
| 3,564,741 | 2/1971 | Kahre et al. | 40/107 |
| 3,670,436 | 6/1972 | Weissmann | 40/107 |
| 4,472,892 | 9/1984 | Yang | 40/107 |
| 4,596,082 | 6/1986 | Lane | 40/107 |

FOREIGN PATENT DOCUMENTS

| | | |
|---|---|---|
| 2419553 | 11/1979 | France . |
| 831572 | 3/1960 | United Kingdom . |

*Primary Examiner*—Kenneth J. Dorner
*Assistant Examiner*—Wenceslao J. Contreras
*Attorney, Agent, or Firm*—Fred Wiviott

[57] ABSTRACT

A perpetual calendar displaying selected faces or sides of a minimal number of parallelepiped blocks for displaying the year, the days of the month, initial numbering of the weeks of the year and the months of the year spelled out in a choice of several languages.

19 Claims, 1 Drawing Sheet

PERPETUAL CALENDAR

BACKGROUND AND SUMMARY OF THE INVENTION

The present invention relates to perpetual calendars utilizing a plurality of individual parallelepiped blocks which may be arranged to provide not only the day of the month with numerical indicia, but also the particular month spelled out with alphabetical letters, in as many as four different languages, and with a minimum number of blocks used for this purpose, as well as a minimum number of blocks arranged to numerically identify the year, and if desired, to sequentially number each week of the year. A minimum number of blocks may also be provided to indicate the first alphabetical letter of the days of the week in four different languages.

There exists some prior designs of calendars in which the year, month, day or week are depicted on six-sided blocks, which may be of wood or other appropriate material. For instance, the present inventor is aware of the following patents:

U.S. Pat. No. 4,472,892 discloses a calendar in which blocks or pegs are numbered "1" through "31" on one side and designs are placed on the other. There are also seven blocks with abbreviations for the days of the week in English and twelve blocks with the month in English on one side.

U.S. Pat. No. 3,670,436 discloses a calendar which indicates a single month, day and date. This calendar consists of four blocks. The first block includes two months of the year on each face, the second block includes the digits "0" through "5", the third block including an array of digits "0", "1", "2", "6", "7" and "8", and a fourth block including the days of the week.

British Patent No. 831,572 is similar to U.S. Pat. No. 3,670,436, but with two numbered blocks and a third block including the first letter of the days of the week with the letter "M" being reversed for a letter "W".

French Patent No. 2419-553 discloses a perpetual calendar having nine blocks. Two blocks indicate the date, three blocks indicate the day of the week, two blocks indicate the month and two blocks indicate the year.

Although the concepts disclosed in these patents are in some respects similar to the present invention, none of the calendars disclose the system wherein the months and days of the week can be provided in several languages, nor for that matter, each of the other various numerical and alphabetical arrangements recited hereinabove.

In particular, the perpetual calendar of the present invention comprises a plurality of individual parallelepiped blocks and means for supporting the blocks in juxtaposed relationship. This combination may further include numerical indication of the year with:

a total of eight blocks including four of the blocks each bearing a single numerical indicia selected from the array 1–5, inclusive, on each of five sides with the sixth side being left blank, and the remaining four blocks each bearing a single numerical indicia from the array 6–9 and 0, inclusive, on each of five sides with the sixth side left blank.

Further, the current month may be displayed using ten blocks, wherein each block bears a single alphabetical indicia on each of four sides, a single numerical indicia selected from the array 1–9 and 0 is imprinted on the fifth side of a respective block, with the sixth side left blank. The alphabetical and numerical distribution are chosen to permit the month to be spelled in English, French, German and Spanish languages.

The first letters of the days of the week may be displayed with a minimum of seven blocks, wherein the blocks each bear on at least one side the single alphabetical indicia S, M, T, W, T, F, S, but preferably with two sides of each block bearing separate seven-day groups of letters. Each of the groups may be of contrasting color selection, whereby one of the colors may be used to indicate a special day, such as the Sabbath.

Additionally, thirty-one blocks may be arranged to indicate the day of the month and may be numbered consecutively on two separate sides with indicia selected from the array 1–31, inclusive. The separate numbering systems may be of contrasting colors to provide a means of segregating special days, such as holidays, birthdays, etc.

Eleven blocks are provided to indicate the week number of the year for each monthly display wherein five sides of eight blocks bear a numerical indicia. Each of the three remaining blocks have four sides which bear numerical indicia. Remaining sides of the eleven blocks are left blank. The numbers for each side are numbered 1–52, inclusive, so as to provide the required sequential display with a minimum amount of blocks while all blocks are displayed.

DETAILED DESCRIPTION OF A PREFERRED EMBODIMENT

Figure 1:
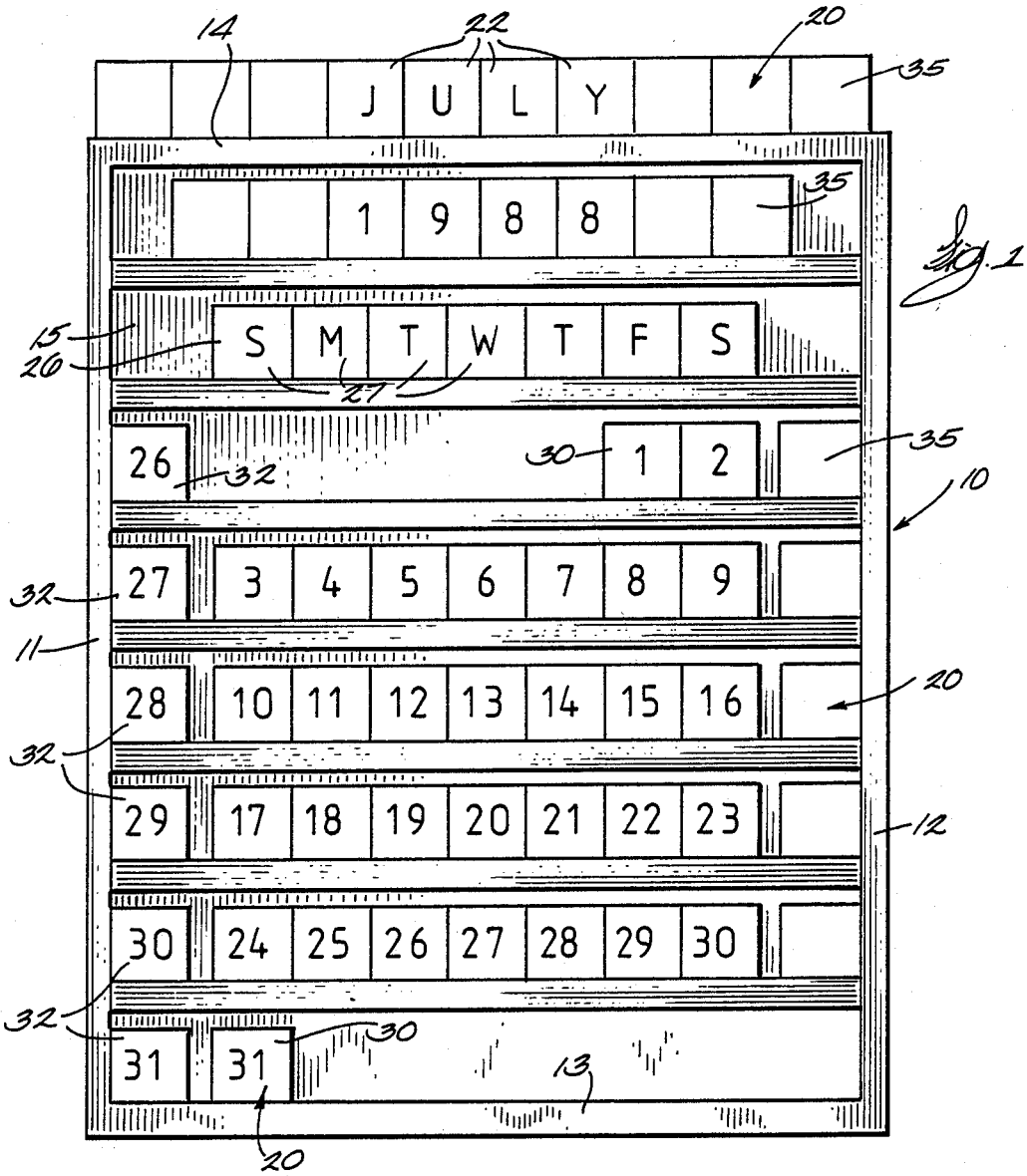
FIG. 1 is a front elevational view of one embodiment of the perpetual calendar according to the present invention.
Figure 2:
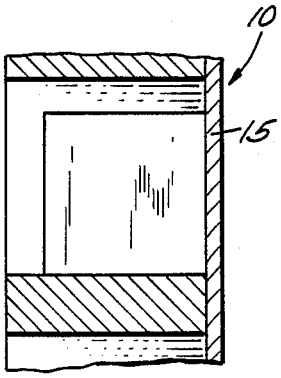
FIG. 2 is a fragmentary, cross sectional view of the supporting showcase of FIG. 1 displaying one of the several blocks made and assembled in accordance with the present invention.
Figure 3:
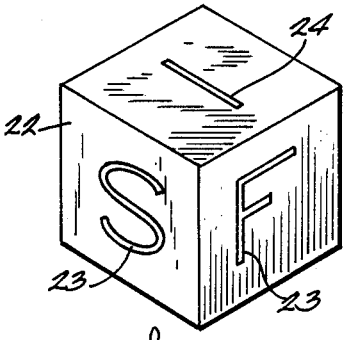
FIG. 3 is a perspective view of three sides of a parallelepiped block of the present invention used to spell out letters of the month in one of four languages.

Referring to FIG. 1, the calendar may include a supporting showcase 10 including upright side walls 11 and 12, a base shelf 13, a top shelf 14 and a backboard 15. A plurality of shelves 16 are provided between the base shelf 12 and the top shelf 14. Additional shelves 16 may be added if desired.

A plurality of parallelepiped blocks 20 are provided to denote various alphabetical and numerical indicia as will hereinafter be described. It is important to bear in mind that a minimum number of blocks are required to denote the month of the year, in as many as four languages, the year, days of the week, days of the month and numerical sequence of the weeks of the year. Thus, the present invention contemplates the use of only eight blocks to designate the year. Ten blocks are required to denote the individual months of the year, and in four languages, namely, English, French, German and Spanish languages. Should it not be desired to provide sequential numbering of the weeks of the year, a maximum of fifty-six blocks will be required to denote the year, month, day and date. It is also within the province of this invention to provide blocks denoting the months of the year in Greek, Italian, Japanese, etc., using separate and code sets.

With attention being given to FIGS. 1–4 of the drawing, it will be observed that the present invention comprises a plurality of individual parallelepiped blocks denoted generally by the reference number 20 displayed in juxtaposed relationship in a supporting showcase 10. With particular attention being had to the blocks 22 resting on the top shelf 14, it will be observed that the months of the year may be spelled out with a set of ten blocks. Each monthly block 22 (see FIG. 3) bears a single alphabetical letter on each of four sides and a single numerical indicia 24 on the fifth side selected from the array 1–9 and 0, and with the sixth side left blank. The alphabetical and numerical distribution of the ten blocks 22 permit the months to be spelled in English, French, German and Spanish language. The distribution of indicia is as follows:

| Block Number | 1 | 2 | 3 | 4 | 5 | 6 | 7 | 8 | 9 | 0 |
|---|---|---|---|---|---|---|---|---|---|---|
| Side 1 | F | J | B | N | U | A | R | Y | A | I |
| Side 2 | S | E | C | U | I | L | G | S | H | K |
| Side 3 | D | A | P | T | E | M | B | E | R | L |
| Side 4 | O | I | N | V | O | Q | W | X | T | Z |
| Side 5 | | | | | Blank | | | | | |
| Side 6 | 1 | 2 | 3 | 4 | 5 | 6 | 7 | 8 | 9 | 0 |

It will be apparent that the side left blank may utilize additional letters to permit spelling variations for additional languages. It will be apparent that the side left blank is for display when a month does not utilize the full set of ten blocks, such as May or July. The remaining blocks then display a blank side. The numerical reference character 24 (see FIG. 3) is supplied to identify the blocks by a specific "Block Number" for selection from the distribution chart to spell out the months in multiple languages.

The preferred embodiment of FIG. 1 further includes seven blocks 26 arranged to indicate the first alphabetical letters of the days of the week. Thus the seven blocks 26 each bear on at least of one side a single alphabetical indicia chosen from the array, S, M, T, W, T, F, S to form a seven-day group of letters. It is also preferred to imprint a second set of the same group of letters in contrasting colors. Thus, one color may be used for usual days, whereas the contrasting color may indicate a special day, such as the Sabbath. Additional letters are included so as to display the first letter of the days of the week in a language corresponding to the monthly spelling.

The first letters of the week in four languages may be selectively arranged as follows:

| | | | | | | | |
|---|---|---|---|---|---|---|---|
| English: | M | T | W | T | F | S | S |
| German: | M | D | M | D | F | S | S |
| French: | L | M | M | J | V | S | D |
| Spanish: | L | M | M | J | V | S | D |

(The underlined letters "S" and "D" are preferably in a contrasting color compared to the remaining letters in the arrangement. For instance, the underlined letters may be in red whereas the remaining letters are in black.)

As is conventional in most calendars, the entire array of twenty-eight, twenty-nine, thirty or thirty-one days of the month, depending on whether February of a leap year, a thirty-day month or a thirty-one-day month is displayed. As shown in FIG. 1, thirty-one blocks 30 are displayed to indicate the day of the month and are numbered consecutively, preferably on at least one side with a single number being chosen from the array 1–31, inclusive. It is also preferred to number sides with daily numbering groups in contrasting color selection. Again, in similar fashion to the day-of-week blocks 26, the contrasting color may be shown to indicate a special day, such as birthdays, holidays and other days to be remembered.

Figure 4:
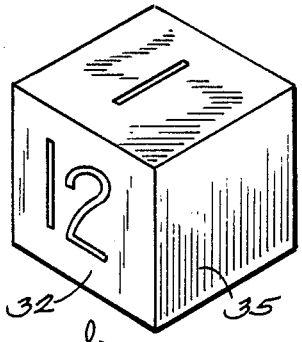
FIG. 4 is a perspective view of a parallelepiped block of the present invention used in sequentially indicating weeks of the year.

The block 32 of FIG. 4 is illustrative of eleven blocks arranged to indicate the sequential number of each week of the year. Thus, each block of eight separate blocks 32 of the eleven blocks has five of its sides respectively bearing a single numerical identification chosen from the array 1–52, inclusive, and with the sixth side left blank, and the fifth side of the remaining three blocks also being left blank. A distribution of the numerical indicia and of the blank sides of the blocks 32 is as follows:

| BLOCK NUMBER | 1 | 2 | 3 | 4 | 5 | 6 | 7 | 8 | 9 | 10 | 11 |
|---|---|---|---|---|---|---|---|---|---|---|---|
| #1 | 1 | 2 | 3 | 4 | 5 | 6 | 7 | 8 | 9 | 10 | 11 |
| #2 | 12 | 13 | 14 | 15 | 16 | 17 | 18 | 19 | 20 | 21 | 22 |
| #3 | 2 | 24 | 25 | 26 | 27 | 28 | 29 | 30 | 31 | 32 | 33 |
| #4 | 34 | 35 | 36 | 37 | 38 | 39 | 40 | 41 | 42 | 43 | 44 |
| #5 | 45 | 46 | 47 | 48 | 49 | 50 | 51 | 52 | BLANK | | |
| #6 | | | | | All Blank | | | | | | |

Each of the eleven blocks may be referred to by numerical indicia of side one. For example, block 5, side one displays the numeral 5 (five), side two displays the numeral 16 (sixteen), side three displays the numeral 27 (twenty-seven), side four displays the numeral 38 (thirty-eight), side five displays the numeral 49 (fourty-nine) while side six displays a blank surface. It is preferred to use numerical indices of contrasting color or form with respect to the thirty-one monthly day blocks which are displayed in relative proximity.

It will be apparent from the foregoing description that there has been provided an improved perpetual calendar using a minimal number of indicia-bearing blocks for indicating, if desired, the month and year, the first letter of the days of the week, the days of the month and the sequential numbering of the weeks of the year, as desired. It will be further apparent that the blank sides 35 of the various blocks may be faced forward as shown in FIG. 1, in order to avoid confusion with numbers or letters that are to be displayed. This arrangement further permits storage in situ on the showcase 20, to thereby minimize the misplacement or loss of individual blocks.

What I claims is:

1. A perpetual calendar comprising a plurality of individual parallelepiped blocks each having a plurality of sides and a plurality of generally horizontally extending support means spaced apart vertically one from the other and defining a front and a rear, a first group of said blocks having numerals applied to at least a plurality of sides thereof and being arranged on a first one of said support means with one of said plurality of sides oriented toward the front of said support for displaying the year;

a second group of said blocks having letters formed on at least one surface thereof and being disposed on a second one of said support means and oriented with one of said plurality of sides oriented toward the front of said support to display the month alphabetically;

a third group of said blocks having letters on at least one surface thereof and disposed on a third one of said support means and oriented with one of said plurality of sides oriented toward the front of said support for displaying the first letters of the days of the week; and a fourth group of said blocks each having a number on at least one surface thereof facing the front of said support and being arranged in subgroups of at least seven, said subgroups being disposed, respectively, on fourth, fifth, sixth, seventh, and eighth ones of said support means, the blocks of said fourth group being oriented with one of their sides oriented toward the front of said support to display the days of the month sequentially, whereby said blocks may be arranged to display individual months of the year in perpetuity.

2. The perpetual calendar set forth in claim 1 wherein each of said support means includes a shelf whereby said blocks may be slid horizontally on said shelves, and frame means supporting said shelves horizontally and in a spaced apart relation.

3. The perpetual calendar set forth in claim 2 and including a fifth group of blocks each having a number on at least one face thereof and each being disposed on a different one of said fourth, fifth, sixth, seventh, and eighth support means and arranged to display the sequential number of each week of the year.

4. The perpetual calendar set forth in claim 2, wherein said first group of blocks comprises eight blocks arranged to display the year, wherein four blocks each bear a single numeral 1–5, inclusive on each of five sides and with the sixth sides left blank, and four blocks each bear a single numeral 6–9 and 0, inclusive, on each of five sides and with the sixth side left blank.

5. The perpetual calendar set forth in claim 2, wherein said second group of blocks comprises ten blocks arranged to display the month, wherein each block of said second group bears a single alphabetical letter on each of four sides, the alphabetical distribution array of at least four sides of each block being as follows:

| BLOCK NUMBER | 1 | 2 | 3 | 4 | 5 | 6 | 7 | 8 | 9 | 0 |
|---|---|---|---|---|---|---|---|---|---|---|
| Side 1 | F | J | B | N | U | A | R | Y | A | I |
| Side 2 | S | E | C | U | I | L | G | S | H | K |
| Side 3 | D | A | P | T | E | M | B | E | R | L |
| Side 4 | O | I | N | V | O | Q | W | X | T | Z |
| Side 5 | | | | | Blank | | | | | |

whereby the said distribution permits the months to be spelled in the English, French, German, and Spanish languages.

6. The perpetual calendar set forth in claim 5 wherein each block of said second group of blocks includes means for identifying individual blocks bearing alphabetical letters of respective columns of the said distribution array.

7. The perpetual calendar set forth in claim 6 wherein the identifying means comprises numerical indicia on one of the two remaining sides.

8. The perpetual calendar set forth in claim 2 wherein said third group of blocks comprises seven blocks arranged to display the first letters of the days of the week in English, French, German, and Spanish, and wherein said each block of said third group bears on at least three sides thereof a single alphabetical letter, the alphabetical distribution array forming a seven-day group of letters as follows:

| BLOCK NUMBER | 1 | 2 | 3 | 4 | 5 | 6 | 7 |
|---|---|---|---|---|---|---|---|
| Side 1 | M | T | W | T | F | S | S |
| Side 2 | L | M | M | J | V | D | D |
| Side 3 | | D | | D | | S | S |
| Side 4 | | | | BLANK | | | |
| Side 5 | | | | BLANK | | | |

9. The perpetual calendar set forth in claim 8 wherein the said single alphabetical letters are individually disposed on at least two sides of each block, and wherein like letters are in contrasting colors, and whereby one of said colors may be selected to denote a special day, such as the Sabbath.

10. The perpetual calendar set forth in claim 2 wherein said fourth group of blocks comprises thirty-one blocks, arranged to display the day of the month and numbered consecutively on at least one side with a single numeral 1–31, inclusive.

11. The perpetual calendar set forth in claim 10 wherein the numerical indicia is numbered sequentially on at least two separate sides of each block providing the separate daily numbering groups, each group being of contrasting color selection, whereby an individual day or days selection may denote a special day, such as a holiday, birthday, or the like.

12. The perpetual calendar set forth in claim 2 wherein said fifth group of blocks comprises eleven blocks arranged to display the sequential number of each week of the year, wherein each block of eight blocks of said eleven blocks have five sides respectively bearing a single numerical identification 1–52, inclusive, and with the sixth side left blank and with the fifth side of the remaining three blocks being left blank, the distribution of said numerals and said blank sides being as follows:

| BLOCK NUMBER | 1 | 2 | 3 | 4 | 5 | 6 | 7 | 8 | 9 | 10 | 11 |
|---|---|---|---|---|---|---|---|---|---|---|---|
| Side 1 | 1 | 2 | 3 | 4 | 5 | 6 | 7 | 8 | 9 | 10 | 11 |
| Side 2 | 12 | 13 | 14 | 15 | 16 | 17 | 18 | 19 | 20 | 21 | 22 |
| Side 3 | 23 | 24 | 25 | 26 | 27 | 28 | 29 | 30 | 31 | 32 | 33 |
| Side 4 | 34 | 35 | 36 | 37 | 38 | 39 | 40 | 41 | 42 | 43 | 44 |
| Side 5 | 45 | 46 | 47 | 48 | 49 | 50 | 51 | 52 | | Blank | |
| Side 6 | | | | | Blank | | | | | | |

13. The perpetual calendar set forth in claim 4 wherein said second group of blocks comprises ten blocks arranged to display the month, wherein each block of said second group bears a single alphabetical letter on each of four sides, the alphabetical distribution array of at least four sides of each block being as follows:

| BLOCK NUMBER | 1 | 2 | 3 | 4 | 5 | 6 | 7 | 8 | 9 | 0 |
|---|---|---|---|---|---|---|---|---|---|---|
| Side 1 | F | J | B | N | U | A | R | Y | A | I |
| Side 2 | S | E | C | U | I | L | G | S | H | K |
| Side 3 | D | A | P | T | E | M | B | E | R | L |
| Side 4 | O | I | N | V | O | Q | W | X | T | Z |

-continued

| BLOCK NUMBER | 1 | 2 | 3 | 4 | 5 | 6 | 7 | 8 | 9 | 0 |
|---|---|---|---|---|---|---|---|---|---|---|
| Side 5 | | | | | Blank | | | | | |

whereby said distribution permits the months to be spelled in the English, French, German, and Spanish languages.

14. The perpetual calendar set forth in claim 13 wherein said third group of blocks comprises seven blocks arranged to display the first letters of the days of the week in English, French, German, and Spanish, and wherein said each block of said third group bears on at least three sides thereof a single alphabetical letter, the alphabetical distribution array forming a seven-day group of letters as follows:

| BLOCK NUMBER | 1 | 2 | 3 | 4 | 5 | 6 | 7 |
|---|---|---|---|---|---|---|---|
| Side 1 | M | T | W | T | F | S | S |
| Side 2 | L | M | M | J | V | D | D |
| Side 3 | | D | | D | | S | S |
| Side 4 | | | | BLANK | | | |
| Side 5 | | | | BLANK | | | |

said single alphabetical letters being individually disposed on at least two sides of each block, and wherein like letters are in contrasting colors, and whereby one of said colors may be selected to denote a special day, such as the Sabbath.

15. The perpetual calendar set forth in claim 14 wherein said fourth group of blocks comprises thirty-one blocks, arranged to display the day of the month and numbered consecutively on at least one side with a single numeral 1–31, inclusive.

16. The perpetual calendar set forth in claim 15 wherein the numerical indicia is numbered sequentially on at least two separate sides of each block providing the separate daily numbering groups, each group being of contrasting color selection, whereby an individual day or days selection may denote a special day, such as a holiday, birthday, or the like.

17. The perpetual calendar set forth in claim 16 wherein said fifth group of blocks comprises eleven blocks arranged to display the sequential number of each week of the year, wherein each block of eight blocks of said eleven blocks has five sides respectively bearing a single numerical identification 1–52, inclusive, and with the sixth side left blank and with the fifth side of the remaining three blocks being left blank, the distribution of said numerals and said blank sides being as follows:

| BLOCK NUMBER | 1 | 2 | 3 | 4 | 5 | 6 | 7 | 8 | 9 | 10 | 11 |
|---|---|---|---|---|---|---|---|---|---|---|---|
| Side 1 | 1 | 2 | 3 | 4 | 5 | 6 | 7 | 8 | 9 | 10 | 11 |
| Side 2 | 12 | 13 | 14 | 15 | 16 | 17 | 18 | 19 | 20 | 21 | 22 |
| Side 3 | 23 | 24 | 25 | 26 | 27 | 28 | 29 | 30 | 31 | 32 | 33 |
| Side 4 | 34 | 35 | 36 | 37 | 38 | 39 | 40 | 41 | 42 | 43 | 44 |
| Side 5 | 45 | 46 | 47 | 48 | 49 | 50 | 51 | 52 | | Blank | |
| Side 6 | | | | | Blank | | | | | | |

18. A perpetual calendar comprising a plurality of individual parallelepiped blocks and support means, said support means defining front and rear sides and including a plurality of generally horizontally extending support means arranged vertically one below the other for supporting groups of the blocks in a juxtaposed relationship, said blocks each having a plurality of sides, a first group of blocks disposed on a first one of said support means wherein four blocks each bear a single numeral 1–5, inclusive, on each of five sides and with the sixth side left blank, and four blocks each bear a single numeral 6–9 and 0, inclusive, on each of five sides and with the sixth side left blank, selected sides of said first group of blocks facing forwardly and arranged to display the year;

a second group of ten blocks disposed on a second one of said support means and each block bearing a single alphabetical letter on each of four sides, a single numeral 1–9 and 0 on the fifth side and with the sixth side left blank, the alphabetical and numerical distribution being as follows:

| BLOCK NUMBER | 1 | 2 | 3 | 4 | 5 | 6 | 7 | 8 | 9 | 0 |
|---|---|---|---|---|---|---|---|---|---|---|
| Side 1 | F | J | B | N | U | A | R | Y | A | I |
| Side 2 | S | E | C | U | I | L | G | S | H | K |
| Side 3 | D | A | P | T | E | M | B | E | R | L |
| Side 4 | O | I | N | V | O | Q | W | X | T | Z |
| Side 5 | | | | | Blank | | | | | |
| Side 6 | 1 | 2 | 3 | 4 | 5 | 6 | 7 | 8 | 9 | 0 |

selected sides of said second group of blocks facing forwardly and arranged to spell a month in a language taken from the group consisting of English, French, German, and Spanish, said numerals serving as block identifiers;

a third group of seven blocks disposed on a third one of said support means and having selective sides facing forwardly and arranged to display the first letters of the days of the week in a language taken from the group consisting of English, French, German, and Spanish, said blocks each bearing on at least each of two sides the single alphabetical letter S, M, T, W, T, F, S forming two separate seven-day subgroups of letters, and each of said subgroups being of contrasting color selection, whereby one of said colors may be used to denote a special day, such as the Sabbath;

a fourth group of thirty-one blocks arranged in subgroups of seven or less with each subgroup being disposed on a different one of said fourth, fifth, sixth, seventh, and eighth support means and providing two separate daily numbering groups, each group being of contrasting color selection, said blocks of said fourth group being arranged with selected sides facing forwardly such that the days of a month are sequentially arrayed; and a fifth group of six blocks, selected blocks of said fifth group being disposed respectively on said fourth, fifth, sixth, seventh, and eighth support means, each of said blocks being taken from a group of eleven blocks having the following number distribution:

| BLOCK NUMBER | 1 | 2 | 3 | 4 | 5 | 6 | 7 | 8 | 9 | 10 | 11 |
|---|---|---|---|---|---|---|---|---|---|---|---|
| Side 1 | 1 | 2 | 3 | 4 | 5 | 6 | 7 | 8 | 9 | 10 | 11 |
| Side 2 | 12 | 13 | 14 | 15 | 16 | 17 | 18 | 19 | 20 | 21 | 22 |
| Side 3 | 23 | 24 | 25 | 26 | 27 | 28 | 29 | 30 | 31 | 32 | 33 |
| Side 4 | 34 | 35 | 36 | 37 | 38 | 39 | 40 | 41 | 42 | 43 | 44 |
| Side 5 | 45 | 46 | 47 | 48 | 49 | 50 | 51 | 52 | | Blank | |
| Side 6 | | | | | Blank | | | | | | |

and oriented on said support means to display the week number of the year in the forwardly direction.

19. The perpetual calendar set forth in claim 18 wherein each of said support means includes a shelf whereby said blocks may be slid horizontally on said shelves, and frame means support said shelves horizontally and in a spaced apart relation.

* * * * *